United States Patent [19]

Wilson

[11] 4,213,765

[45] Jul. 22, 1980

[54] OXIDATIVE COAL DESULFURIZATION USING LIME TO REGENERATE ALKALI METAL HYDROXIDE FROM REACTION PRODUCT

[75] Inventor: Stephen T. Wilson, Shrub Oak, N.Y.

[73] Assignee: Union Carbide Corporation, New York, N.Y.

[21] Appl. No.: 119

[22] Filed: Jan. 2, 1979

[51] Int. Cl.[2] ..... C10L 9/10; C10B 57/00

[52] U.S. Cl. ..... 44/15 R; 201/17

[58] Field of Search ..... 44/15 R; 201/17

[56] References Cited

U.S. PATENT DOCUMENTS

| | | | |
|---|---|---|---|
| 3,960,513 | 6/1976 | Agarwal et al. | 44/15 R |
| 4,054,420 | 11/1977 | Loganbach | 44/15 R |
| 4,055,400 | 10/1977 | Stambaugh et al. | 44/15 R |

*Primary Examiner*—Carl F. Dees

*Attorney, Agent, or Firm*—Saul R. Bresch

[57] ABSTRACT

A process for the removal of pyrite from coal which comprises preparing an aqueous slurry containing finely-divided coal particles; adding to the slurry an alkali metal hydroxide selected from the group consisting of sodium hydroxide, potassium hydroxide and lithium hydroxide, as well as mixtures thereof, in amounts sufficient to continuously maintain the pH of the slurry at a value of below about 8; agitating the slurry while treating the slurry with oxygen or an oxygen-containing gas to convert the pyrite in the coal to a soluble alkali metal sulfate; reacting lime with the so-formed alkali metal sulfate to regenerate the alkali metal hydroxide and then recycling the hydroxide for use in the process.

3 Claims, 2 Drawing Figures

14
FILTER
Pump
16
10
$O_2$
LEACHING REACTOR
Clean Coal
Coal
12
REGENERATION REACTOR
CaO
$CaSO_4 \cdot 2H_2O$
Pump
20
22
pH CONTROLLER
FILTER
18

PERCENT
140
120
100
80
60
40
20
0
3
4
5
6
7
8
pH
Percent $FeS_2$ leached
Percent water insoluble sulfate S x 100
Percent (Ca + Na) x 100

OXIDATIVE COAL DESULFURIZATION USING LIME TO REGENERATE ALKALI METAL HYDROXIDE FROM REACTION PRODUCT

The present invention relates to an improved process for the removal of pyritic sulfur from coal.

The present energy crisis has produced both economic and governmental incentives to use more coal as fuel to replace oil and gas imported in ever increasing amounts. Counterbalancing these incentives are governmental regulations which establish a permissible level of pollutants from the combustion of these fuels. One of the major pollutants is sulfur dioxide. Unfortunately, most of the coal reserves in this country contain sulfur in amounts which are too excessive to burn in compliance with existing law. Major consumers of coal, such as electric utilities, have two alternatives to follow, namely they can buy low sulfur content coal or use flue gas desulfurization to remove sulfur dioxide after combustion. The first alternative would be most feasible if sulfur could be removed from coal using methods which are both practical and economical.

In my copending application Ser. No. 952,108, filed on Oct. 17, 1978, entitled "Mild Oxidative Coal Desulfurization", a process for the removal of pyritic sulfur from coal by chemical oxidation utilizing a basic reaction medium is disclosed and claimed. In this process, an aqueous slurry containing finely-divided coal particles is first prepared and the pH of the slurry maintained at a value of between about 8 and 12 by the addition of an alkali or alkaline earth metal hydroxide or carbonate. The coal slurry is then agitated while being treated with oxygen or an oxygen containing gas such as air. Alkali and alkaline earth metal hydroxides and carbonates that are useful in this process are the hydroxides and carbonates of sodium, lithium, potassium and magnesium. The process can be carried out at temperatures that are only slightly above ambient, e.g. 40–70° C., and at atmospheric pressure. Therefore, there is no need to buy or maintain equipment capable of handling abusive conditions.

A disadvantage of the above described process is that it requires the use of large quantities of the alkali or alkaline earth metal hydroxide or carbonate which increases the cost of the process. Moreover, the product coal after treatment may contain an undesirably high quantity of the alkali or alkaline earth metal, e.g. sodium, which could eventually lead to corrosion of the combustion equipment. The quantity of metal in the coal can be significantly reduced by acid treatment but this also adds to the cost of the process.

SUMMARY OF THE INVENTION

It has been discovered in accordance with the present invention that the above mentioned disadvantages can be effectively avoided and an improved process provided for the removal of pyritic sulfur from coal by adding lime to the reaction products in order to regenerate alkali metal hydroxide for use in the process. The alkali metal hydroxide is formed by reaction of the lime with the metallic sulfate that is produced during oxidation of the pyritic sulfur in the coal. It has been found that when the regenerated alkali metal hydroxide solution is used as the caustic in the process, the pH of the coal slurry should be kept below about 8 and preferably at a value of about 5 or 6. The slurry should also be maintained at a temperature of at least about 70° C. In addition to regenerating alkali metal hydroxide for use in the process, a further advantage of this improved process is that at the lower pH values contemplated there is less chance of objectionable quantities of metallic impurities depositing in the treated coal.

BRIEF DESCRIPTION OF THE DRAWING

The present invention will now be described in greater detail with reference to the accompanying drawing wherein.

DESCRIPTION OF THE PREFERRED EMBODIMENTS

Figure 1:
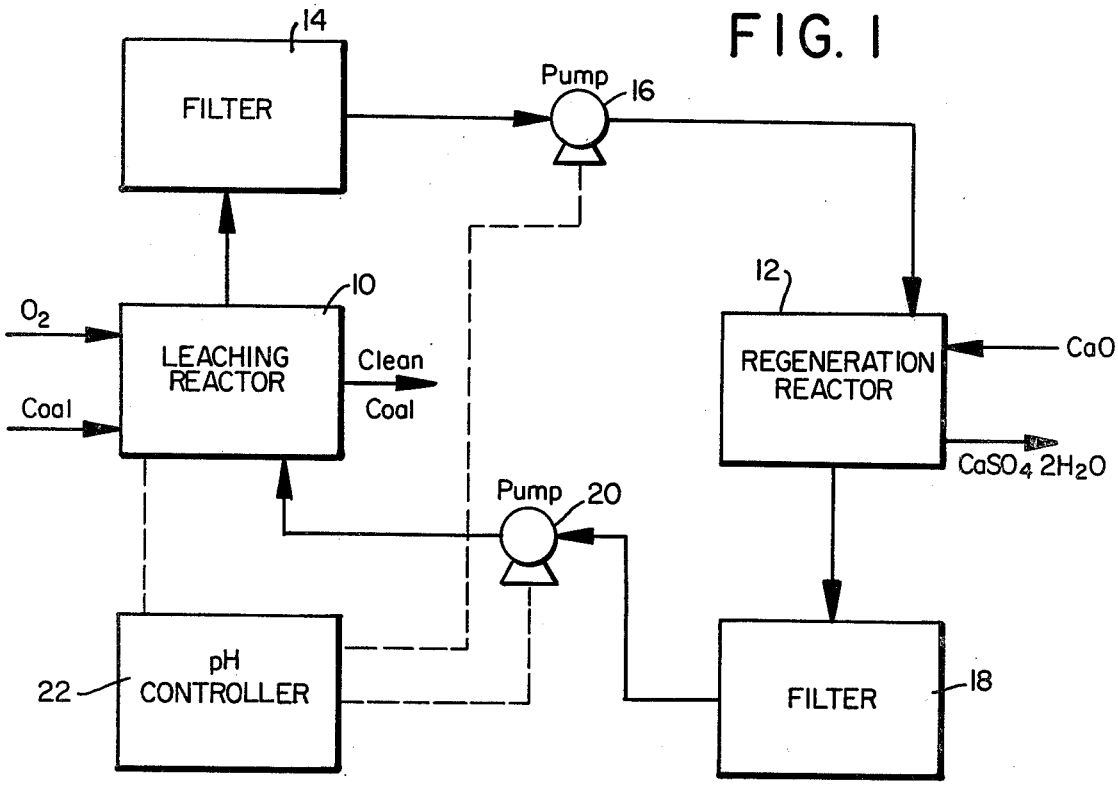
FIG. 1 is a block diagram illustrating the improved process of the present invention.

The process of pyrite removal from coal by chemical oxidation in an alkaline medium, e.g. sodium hydroxide, proceeds according to the following equation;

$$FeS_2 + 4\,NaOH + 3.75\,O_2 \longrightarrow 0.5\,Fe_2O_3 + 2\,Na_2SO_4 + 2\,H_2O \quad (1)$$

It will be seen from equation (1) above that the pyritic sulfur in the coal is oxidized to sulfate which is soluble in the reaction medium. The iron remains in the treated coal as an insoluble oxide or hydroxide. This desulfurization process may be carried out at high rates of pyrite removal from the coal under certain optimum conditions, e.g. temperatures of between 50 and 60° C., pH values of about 10 or 11 and at atmospheric pressure. Approximately 90% of the pyrite can be removed from the coal in about two days under these conditions. Conventional solids-liquid separation techniques can be employed to recover the treated or desulfurized solid coal.

It has been proposed to modify the desulfurization process described above by adding lime, e.g. CaO or $Ca(OH)_2$, to the reaction product in order to convert the sodium sulfate to sodium hydroxide and thereby to regenerate additional sodium hydroxide for use in the process. This regeneration of NaOH proceeds according to the following equation:

$$Na_2SO_4 + CaO + H_2O \rightleftharpoons CaSO_4 + 2NaOH \quad (2)$$

The regeneration reaction as represented by equation (2) above actually does not go to completion with all of the sodium sulfate reacting with lime to form additional NaOH. Some unreacted sodium sulfate will remain in the liquid phase of the reaction product along with the regenerated sodium hydroxide and a small amount of $CaSO_4$. Also, the solid phase in the reaction product will contain some $Ca(OH)_2$ along with the $CaSO_4 \cdot 2H_2O$. It has been found that the presence of calcium ions in the regenerated NaOH solution can dramatically impede the oxygen leaching of pyritic sulfur in the coal at pH values of above about 8. In addition, the problem of residual sodium and calcium in the product coal still persists.

It has been discovered in accordance with the present invention that the inhibiting effect of calcium ions when present in the regenerated NaOH solution upon the oxygen leaching of pyritic sulfur from coal can be effectively overcome by lowering the pH of the coal slurry to a value of below about 8 and preferably to a pH of about 5 or 6. At these lower pH values, the reaction rate slows up considerably and oxygen leaching of pyritic sulfur from coal, e.g. approximately 90% removal, may take as long as two weeks to complete. However, it has been found that the reaction rate can be significantly increased by carrying out the reaction at slightly elevated temperatures of at least about 70° C. Approximately 90% removal of pyritic sulfur from coal can be attained at these temperatures over a period of about six days.

Another inherent advantage of using the lower pH is that less calcium and sodium are incorporated into the product coal. It has been found for example that less than about 0.1 weight percent of calcium and sodium are deposited in the coal when the slurry is maintained at a pH of about 6.

It will be understood that the present invention is broadly applicable to the treatment of various types of coal. In particular, the process is directed to the desulfurization of bituminous coals which are combusted to generate steam in electric utility plants or industrial boilers. Coals that may be treated in accordance with the present invention are the medium and high volatile coals such as, for example, Ohio No. 6 coal. It will also be understood that the present invention is not limited to the treatment of the above mentioned coals alone and that coals other than bituminous coals such as anthracite and lignite coal may be treated as well. In general, the coals that are treated in accordance with the present invention will contain pyritic sulfur concentration in the range of from about 0.5 to about 4% by weight of the coal.

The raw coal which is obtained from mines in chunk size, for example, is first reduced to a finely divided particle size. The particle size of the coal should be sufficient to expose a substantial fraction of the total surface of the pyrite that is contained in the coal. Generally speaking, the coal is reduced to a particle size smaller than about 200 mesh.

The finely divided coal particles are formed into an aqueous slurry, for example, by mixing the coal particles together with water in a reactor. The coal slurry should preferably possess a solids concentration in the range of between about 4 and 40% by weight coal.

The desulfurization process is started by adjusting the pH of the coal slurry to a value of below about 8 and preferably to a pH of about 5 or 6. The pH of the slurry is initially adjusted by the addition of a caustic, such as sodium hydroxide or other alkali metal hydroxide as shall be described further hereinafter. The coal slurry is then agitated and subjected to an oxidizing medium such as oxygen or an oxygen-containing gas e.g. air. The oxygen or air should be introduced in intimate contact with the coal slurry. This may be accomplished for example by bubbling oxygen through the slurry or by aerating the slurry in the reactor. It may be necessary to periodically add caustic to the slurry in order to continuously maintain the pH of the slurry within the desired range. The slurry is also maintained at a slightly elevated temperature of about 70° C. The pressure in the reactor is kept at about atmospheric.

Sodium hydroxide or other caustic used in the process is regenerated according to equation (2) above by the addition of lime e.g. CaO or CaOH, to the reaction product. The reaction product is filtered and removed from the reactor and is fed together with the required amount of lime to a separate reactor, e.g. a caustic regeneration reactor. The regenerated sodium hydroxide that is formed in this reactor is then filtered and fed back to the first reactor for use in the process. The solid $CaSO_4$ that is also formed in this reaction is then removed from the regeneration reactor and discarded as waste.

Although it is preferred to employ sodium hydroxide as the caustic reagent in the practice of the present invention, it is expected that other alkali earth metal hydroxides such as lithium and potassium hydroxide will work as well. However, both lithium and potassium hydroxide are expensive to employ on a commercial scale and therefore the use of these caustic materials in the process may be prohibitive. Although the alkali and alkaline earth metal carbonates such as sodium carbonate as well as the carbonates and hydroxides of magnesium are useful in the desulfurization process disclosed in my copending application Ser. No. 952,108, these caustic materials are not compatible in the regeneration process and therefore should not be employed.

Referring to FIG. 1 of the drawing, there is shown a block diagram of the process wherein the reactor 10 is the main leaching reactor and reactor 12 is the caustic regeneration reactor. As illustrated, reactor 10 has its own filter 14 and pump 16 for feeding the reaction product into the reactor 12. The reactor 12 also has its own filter 18 and pump 20 for feeding the regenerated NaOH back to the reactor 10. Pumps 16 and 20 are activated by a pH controller 22 which is connected to the reactor 10.

The following examples will serve to further illustrate the present invention.

EXAMPLE I

The leaching reactor used in this experiment was a 1 liter reaction kettle provided with a gas inlet at the bottom. This reactor was also equipped with a heating mantle, thermocouple, mechanical stirrer and a pH controller. The caustic regeneration reactor was a 500cc round bottom flask equipped with a magnetic stirrer.

The filters for each reactor were medium porosity fritted glass immersion filters. The filters were submerged in the corresponding slurry. Peristaltic pumps were used to pump the liquids between the slurry reactors. The pumps were activated by the pH controller.

The regeneration reactor was charged with 25 g CaO and 250 cc 0.11 M $Na_2SO_4$. The resulting slurry was magnetically stirred at ambient temperature, isolated from the atmosphere.

The leaching reactor was charged with 700 cc of 0.11 M $Na_2SO_4$ solution and heated to the desired temperature. The desired gas was injected through the gas inlet in the bottom of the reaction. Stirring was accomplished by mechanically driven impeller.

50 g of −200 mesh Ohio No. 6 coal was added to the leaching reactor. The coal was allowed 10–15 minutes to wet, then the pH controller was allowed to bring the coal slurry to the working pH by feeding a liquid stream from the leaching reactor to the regeneration reactor and returning an equal amount of regenerated NaOh solution to the leaching reactor.

The rate of reaction was followed in two ways. Slurry samples were removed from the leaching reactor and the collected coal was analyzed for total sulfur. In addition, the rate was monitored by observing the amount of regenerated liquid which was recycled.

At the end of the reaction the remaining coal slurry was filtered and a filtrate sample was collected. The coal was washed several times with water and air dried.

Table I below contains data on leaching rates obtained in this experiment. Percent pyrite removal from the coal is shown for different values of pH and resident times.

TABLE I

% $FeS_2$ Leached* as Function of pH and Time

| Day | pH 3 | 4 | 5 | 6 | 7 | 8 |
|---|---|---|---|---|---|---|
| 1 | 8 | 39 | 45 | 63 | 56 | 63 |
| 2 | 23 | 54 | 68 | — | 68 | 80 |
| 3 | — | — | 72 | — | — | — |
| 6 | 42 | 63 | 78 | 92 | 74 | 80 |

*Starting Coal - 1.58% pyritic sulfur, 1.57% organic sulfur and 0.55% sulfate sulfur.

It will be seen from Table I that the rate of leaching declines rapidly after 24 hours at pH 4–8. From 50–80% of the final sulfur removal occurs in this first 24 hour period.

EXAMPLE II

Another experiment to evaluate the effect of pH on the final coal product was conducted. The starting coal was again −200 mesh Ohio No. 6 coal and the slurry concentration was about 6% by weight. Basically the same procedures were used in this experiment as outlined in Example I above except that a treatment period of 6 days was chosen to attempt complete removal of the pyritic sulfur. The pH of the slurry was varied but always maintained at a value below about 9. The temperature was kept at about 70° C. to try to offset any decline in the leaching rate due to the lower reaction pH. The flow rate of oxygen was 0.2 SCFH and the initial sodium concentration was 0.22 moles/liter. Table II below sets forth data obtained in the experiment.

TABLE II $O_2$ Leaching of Pyritic Sulfur in Coal at pH Values <9

| Sample No. | pH | % of Product HCl Soluble Fe | Na | Ca |
|---|---|---|---|---|
| 1 | 3 | 1.9 | .0720 | .0133 |
| 2 | 4 | 2.0 | .0482 | .0219 |
| 3 | 5 | 2.2 | .0631 | .0373 |
| 4 | 6 | 2.0 | .137 | .0795 |
| 5 | 7 | 1.46 | .27 | .20 |
| 6 | 8 | 1.47 | .33 | 1.04 |

It will be seen from Table II above that the amount of calcium and sodium in the product coal declines with decreasing pH. At a pH of 5 or less both sodium and calcium are less than 0.1% of the product coal.

Proximate analysis of the product coals is shown in Table III below.

It will be seen from Table III above that the optimum pH range for leaching pyrite from coal is 5–6. 84% of the pyritic sulfur is removed in 6 days. If additional credit is taken for the organic sulfur removed, the equivalent of 92% pyritic sulfur removal is achieved. The residual sulfate sulfur in the product following a water wash is low, e.g. about 0.1%, in coals treated at a pH of 4–8. At pH 3, significantly more water insoluble sulfate 0.5% remains. The BTU content on a moisture and ash free basis (MAF) is unaffected by treatment.

Figure 2:
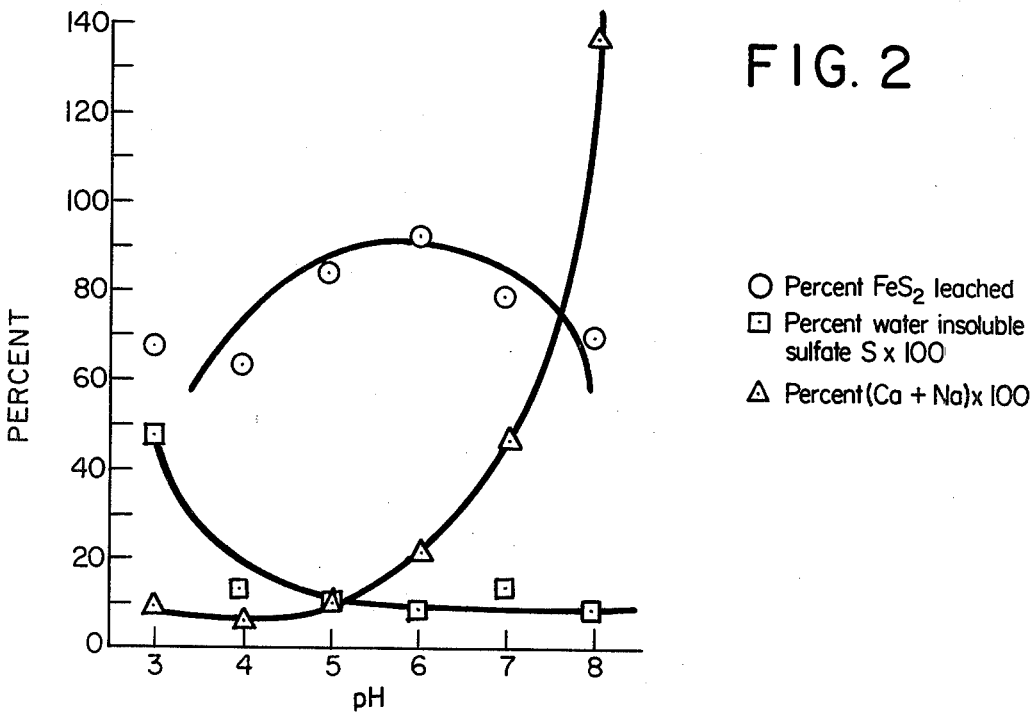
FIG. 2 is a graph which illustrates the relationship between the pH of the slurry and the characteristics of the product coal.

Thus it will be seen that the present invention provides a novel process for removing pyrite from coal by oxygen leaching in caustic medium, e.g. NaOH, under mild conditions wherein lime is added to the reaction product in order to regenerate additional alkali or caustic reagent for use in the process. Although the slurry should be maintained at a pH less than about 8, the optimum pH for sulfur removal was found to be 5–6. In FIG. 2 there is shown the relationship between the pH and the percent pyritic sulfur leached, the percent water insoluble sulfate sulfur and the percent (Ca+Na). It is apparent from the graph that a pH of 5–6 also optimizes the characteristics of the product coal. It has been found that for optimum results the temperature of the coal slurry should be maintained at above about 70° C. and that a residence time of about 6 days is usually required for completion of the desulfurization reaction.

What is claimed is:

1. A process for the removal of pyrite from coal which comprises (a) preparing an aqueous slurry containing finely-divided coal particles; (b) adding to the slurry an alkali metal hydroxide selected from the group consisting of sodium hydroxide, potassium hydroxide and lithium hydroxide, as well as mixtures thereof, in amounts sufficient to continuously maintain the pH of the slurry at a value of below about 8; (c) agitating the slurry while treating the slurry with oxygen or an oxygen-containing gas at substantially atmospheric pressure and at a slightly elevated temperature of at least about 70° C. to convert the pyrite in the coal to a soluble alkali metal sulfate; (d) reacting lime with the so-formed alkali metal sulfate to regenerate the alkali metal hydroxide, and (e) recycling the hydroxide for further use in the process, whereby pyrite is effectively removed and the hydroxide conveniently regenerated with the inhibiting effect of calcium ions therein upon the oxygen leaching of said pyritic sulfur from coal being overcome at said pH, the reaction rate being enhanced by the use of said elevated temperature.

2. The process as defined by claim 1 wherein the pH of the coal slurry is continuously maintained at a value of about 5 or 6.

3. The process as defined by claim 2 wherein the pH of the coal slurry is maintained by the addition of sodium hydroxide.

* * * * *

TABLE III

Proximate Analyses of Starting and Finishing Coals, pH <9

| Sample # | pH | Moist | Ash | Vol | Fixed C | Total S | Sulfate S | Pyritic S | Organic S | BTU (MAF)* |
|---|---|---|---|---|---|---|---|---|---|---|
| Starting Coal (Ohio #6) | — | 4.05 | 11.09 | 38.48 | 46.38 | 3.70 | 0.55 | 1.58 | 1.57 | 13737 |
| 1 | 3 | 3.81 | 11.33 | 35.76 | 49.10 | 2.56 | 0.48 | 0.40 | 1.68 | 13430 |
| 2 | 4 | 3.61 | 12.10 | 35.40 | 48.89 | 2.28 | 0.13 | 0.49 | 1.66 | 13607 |
| 3 | 5 | 4.14 | 12.01 | 34.82 | 49.03 | 1.94 | 0.11 | 0.28 | 1.55 | 13690 |
| 4 | 6 | 3.57 | 12.32 | 35.67 | 48.44 | 1.78 | 0.09 | 0.25 | 1.44 | 13665 |
| 5 | 7 | 4.66 | 12.41 | — | — | 2.04 | 0.14 | 0.53 | 1.37 | 13708 |
| 6 | 8 | 5.77 | 14.69 | — | — | 2.14 | 0.09 | 0.56 | 1.49 | 13729 |

*MAF - Moisture and ash free basis Values in table are weight - % unless otherwise indicated.